US006669541B2

(12) United States Patent
Andrews

(10) Patent No.: US 6,669,541 B2
(45) Date of Patent: Dec. 30, 2003

(54) ABRADING METHOD AND HOLDING DEVICE

(76) Inventor: William L. Andrews, P.O. Box 1695, Rochester, NH (US) 03866-1695

( * ) Notice: Subject to any disclaimer, the term of this patent is extended or adjusted under 35 U.S.C. 154(b) by 11 days.

(21) Appl. No.: 10/008,319

(22) Filed: Nov. 3, 2001

(65) Prior Publication Data

US 2003/0087595 A1 May 8, 2003

(51) Int. Cl.[7] ..... B24B 41/06

(52) U.S. Cl. ..... 451/342; 451/415; 451/435; 451/911

(58) Field of Search ..... 451/14, 49, 342, 451/343, 365, 377, 415, 424, 425, 435, 436, 480, 487, 911

(56) References Cited

U.S. PATENT DOCUMENTS

| | | | | | |
|---|---|---|---|---|---|
| 603,400 | A | * | 5/1898 | Farmer | 384/272 |
| 744,340 | A | * | 11/1903 | Heald | 451/160 |
| 774,030 | A | * | 11/1904 | Benton | 125/11.01 |
| 966,826 | A | * | 8/1910 | Gommel | 451/436 |
| 968,768 | A | * | 8/1910 | Ireland | 451/436 |
| 1,259,131 | A | * | 3/1918 | Ritz, Jr. | 451/435 |
| 3,456,401 | A | * | 7/1969 | Kushmuk | 451/424 |
| 3,738,226 | A | * | 6/1973 | Dickerson | 409/77 |
| 3,762,106 | A | * | 10/1973 | Yuryan | 451/249 |
| 4,044,650 | A | * | 8/1977 | Lyon et al. | 409/183 |
| 4,545,121 | A | * | 10/1985 | Armbruster et al. | 144/136.1 |
| 5,018,228 | A | * | 5/1991 | Bogaerts et al. | 451/290 |
| 6,374,878 | B1 | * | 4/2002 | Mastley et al. | 144/134.1 |

FOREIGN PATENT DOCUMENTS

| | | | | |
|---|---|---|---|---|
| GB | 2063727 | A | * 6/1981 | B24B/23/02 |

* cited by examiner

*Primary Examiner*—Lee D. Wilson
*Assistant Examiner*—David B. Thomas

(57) ABSTRACT

A method for grinding, polishing, buffing, scaling, and grooving a finish onto and into a workpiece. This method provides the versatility of a hand held type angle grinder to be used while being supported frog, a clamping device. Also provided is a means for supporting a hand held type angle grinder from a clamping device such as a tool post, a tool post tool holder, and a bench vice.

5 Claims, 2 Drawing Sheets

ABRADING METHOD AND HOLDING DEVICE

FIELD OF THE INVENTION

The invention relates to a abrading method such as grinding, polishing, buffing, scaling, and grooving. More particularly, the invention relates to a method that uses the versatility of a hand held type angle grinder to abrade with while its being supported from a clamping device.

The invention also relates to a holding device. More particularly, the invention also relates to a holding device that is used to support a hand held type angle grinder from a clamping device such as a lathe's tool post or a bench vise.

BACKGROUND OF THE INVENTION

There are many types of methods used in which to abrade a finish onto a workpiece. A commonly used method is done by means of mounting a grinder on a lathe (of which hereinafter is referred to as a grinding set up). While a workpiece is being supported and rotated in a lathe, the grinder is used to abrade the workpiece to a precise finish. This type of abrading method will require roughly tooling the workpiece to a rough finish, prior to abrading it to a precise finish.

Tooling a workpiece is done by means of mounting a tool post on a lathe, then a cutting tool is clamped onto and supported by the tool post (of which hereinafter is referred to as a tooling set up). While the workpiece is being supported and rotated in a lathe, the cutting tool is then used to cut or tool the workpiece to a rough finish.

A grinding set up and a tooling set up are set up separately. This is a disavantage as it requires using and wasting costly production time while changing over from one set up to the other. What is needed is a method of grinding and tooling from one set up.

Some jobs require constant changing back and fourth from grinding to tooling. This is a disadvantage due to having to relocate prior precise settings in regards to a workpiece. What is needed is a means to constant change back and fourth from grinding to tooling, and without losing prior settings.

Grinder's that are designed to be mounted onto a lathe's carraige are very costly. Also, these types of grinder's are either heavy and bulky, or light duty with lack of power. This limits these grinders to only specific abrading jobs.

Most hand held type angle grinders are equipped with three side handle sockets. Those side handle sockets are located on top of and on either side of the gear case of the grinder. These side handle sockets are normally used for installing a side handle which can be threaded into any one of those sockets. This allows the operator an option to position the handle into the best suited position.

Arms 2A reaches out comfortably from each side of main body 1A. Then extend over either side of the gear case of the angle grinder so that holes 3A will align over the side handle sockets. Bolts will extend through holes 3A and will thread into the side handle sockets and properly secure the holding device onto the angle grinder.

DISCRIPTION OF RELATED ART

No related art was found in the field of search in area's 82/157, 82/159, 82/160, 82/161, 82/173, 407/66 45/19, 451/66, 451/103, 451/109, 451/111, 451/142, 451/143, 451/344, 451/348, 451/424, 451/911.

BRIEF SUMARY OF THE INVENTION

Grinding, polishing, buffing, scaling, and grooving, are all hereinafter referred to as abrading.

A clamping device that can mount onto a lathe's carriage or compound and can interchangeably support cutting tools or support cutting tool holders is hereinafter referred to as a tool post.

The present invention features a abrading method that uses a hand held type angle grinder to abrade with while its being supported from a tool post. This method will provide easy means of abrading and tooling from one set up.

Using the abrading method with a tool post that supports tool holders will provide fast and easy means to constant change from abrading to tooling and without losing precise settings.

The present invention also features a holding device. The holding device is adapted to be secured onto a hand held type angle grinder. The holding device will provide means to support a hand held type angle grinder from a tool post. Also, the holding device will provide means to support a hand held angle grinder from a tool posts tool holder.

A holding device also has a supporting end that is located on opposite and of a holding end. Supporting end provides a shelf area 4A for a holding device to be clamped onto by a clamping device. One example of a clamping device, but not limited to, is a lathe tool post lathe tool post will attach onto a lathe's carriage incorporates a chamfer or groove of which a lathe cutting tool can be inserted into. A shelf area of a holding device and a shelf area casted from a angle grinder's gear case, can also be inserted into a tool post chamfer. A tool post also incorporates hold down belts. These bolts are located over the chamfered area and are used to thread down onto and fixly clamp a tool theta boon inserted within its chamfer.

Lathe's will vary in size and angle grinders also vary in size. A large lathe will normally he equipped with a large tool post and will require a large holding device for supporting a large angle grinder. A small lathe will normally be equipped with a small tool post and will require a small holding device for supporting a small angle grinder.

A shelf area 4A of FIG. 2 can also be casted as part of the gear case of the angle grinder. Gear case will he casted with a shelf area extending conformingly outward and will not require a separate holding device.

It will be a advantage to support a hand held type angle grinder onto a bench vise. This will allow the operater to safely abrade a small workpiece while having both hands free to hold the workpiece.

BRIEF DISCRIPTION OF THE DRAWINGS

DETAILED DISCRIPTION OF THE INVENTION

The invention features a abrading method that uses the versatility of a hand held type angle grinder to abrade with while its being supported from a clamping device.

The invention also features a holding device that is used for supporting a hand held type angle grinder from a clamping device such as a tool post, tool post tool holder, or a bench vise.

Figure 1:
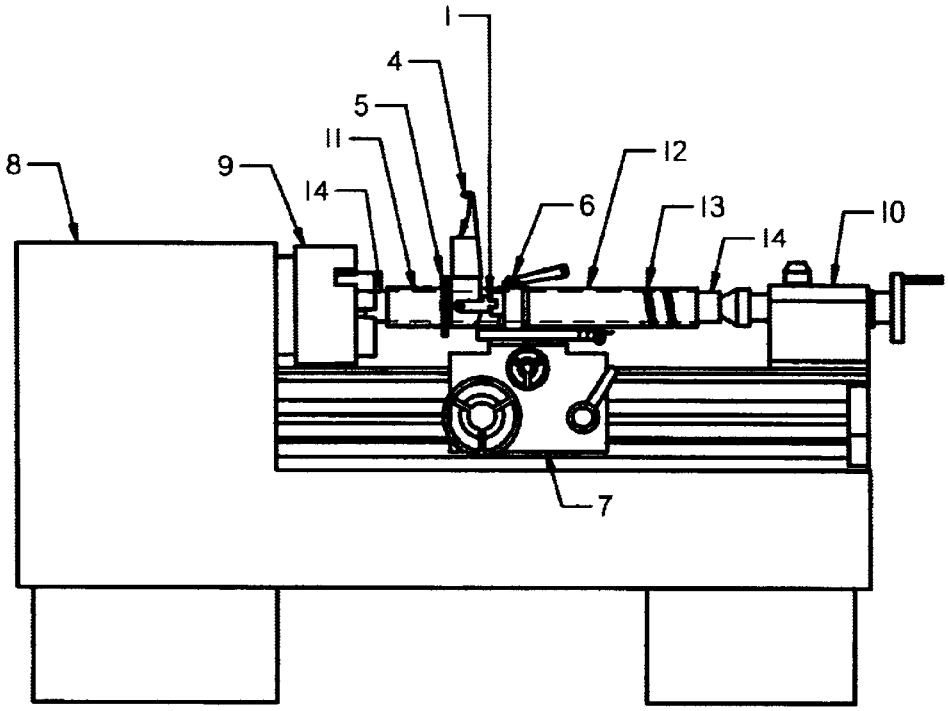
FIG. 1 is a general overall view showing a abrading method according to the invention.

FIG. 1 is a general overall view showing a abrading method according to the invention.

FIG. 1 details the following, a holding device 1, a hand held type angle grinder 4, a abrasive wheel 5, a lathe's tool post 6, a lathe's carriage 7, a lathe 8, a lathe's chuck 9, a lathe's tailstock 10, a roller 11, a non metal covering 12, grooves 13, and journals 14.

FIG. 1 is discribed as follows, the holding end of a holding device 1 is bolted onto a hand held type angle grinder 4. Hand held type angle grinder 4 is supporting, but not limited to, a abrasive wheel 5. The supporting end of holding device 1 is clamped onto, but not limited to, a lathe's turret type tool post 6. Tool post 6 is attached onto a lathe's carriage 7. A lathe 8 is supporting, but not limited to, a cylinder or roller 11 between its chuck 9 and its tail stock 10. Roller 11 is being supported by its journals 14. Some rollers 11 have non metal coverings 12. Some rollers 11 have grooves 13 abraded into its non metal covering 12.

Some examples of a hand held type angle grinder's versatility is explained, but not limited to, as follows.

Still referring to FIG. 1, abrasive wheel 5 can be any of the following.

A stone wheel, used for abrading a precise finish on a steel roller 11 or a rollers covering 12, also used to abrade grooves 13 in a rollers covering 12, also used for abrading a precise finish on a rollers journals 14.

A flapwheel and a non wooven wheel, used for polishing and buffing a finish onto a roller 11, a rollers covering 12, and a rollers journals 14.

A brush, used for scaling off a scale build up located on a rollers journals 14 thats caused from certain environments of its application.

A cut off wheel, used to abrade thin grooves into a rollers covering 12.

Still referring to FIG. 1, holding device 1 can support a hand held type angle grinder 4 while being clamped onto either side of tool post 6 and other tool posts as well.

Still referring to FIG. 1, when abrading grooves 13 into rollers covering 12. Angle grinder 4 can be securely held by holding device 1 in a same position of degree as a pitch degree of grooves 13.

Also a holding device will support a hand held type angle grinder while being clamped from a tool post tool holder. Most tool post tool holders are provided with a height adjustment apparatus. This will benefit in positioning a hand held type angle grinder against a workpiece.

Also some hand held type angle grinders are equipped with, and uses, a belt sanding apparatus such as a MILWAUKEE BAND FILE.

Also yet, it will be a advantage to support a hand held type angle grinder from a bench vise. This will allow the operator to safely abrade a small workpiece while having both hands free to hold the workpiece.

Figure 2:
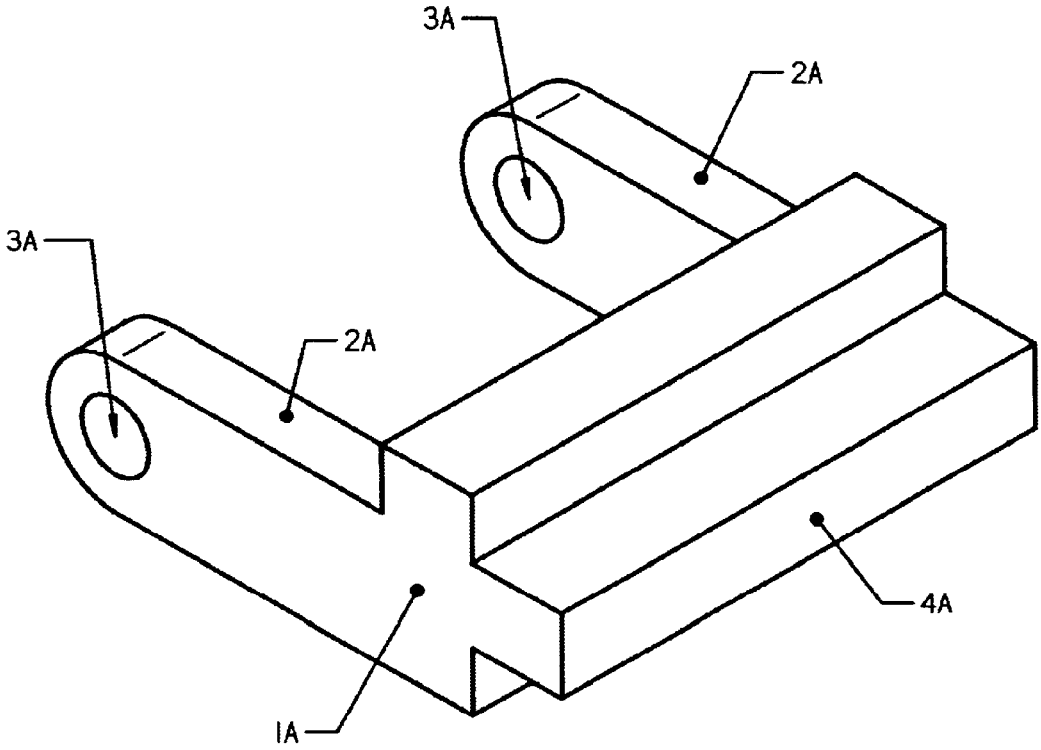
FIG. 2 shows a view of a holding device according to the invention.

FIG. 2 shows a view of a holding device according to the invention and details the following, a main body 1A. Two arms 2A, two holes 3A, and a shelf area 4A.

A holding device comprises of a one piece construction and is preferrably made of steel or a metal alloy. Two arms 2A forms a holding end of a holding device. Arms 2A reaches out conformingly from each side of main body 1A. Located at the outer end of each arm 2A is a hole 3A.

A holding device is sized according to the size of a hand held angle grinder of which it is to be used with. As one example but not limited to, a over all size of a holding device for using with a 7" variable speed and made by MAKITA will be 2⅜" in length, 3½" in width, and 1¼" in thickness. Distance between the arms will be 2¾" and will reach out 1¼". Arms will have a ½" hole centered ⅝" in from its outer end.

Arms 2A will reach out along each side of a hand held type angle grinder accordingly, so that each hole 3A will be located over a theaded area of where a handle would normally be attached. A bolt will extend through each hole 3A of arms 2A and thread into the angle grinder. When the bolts are tightened, the holding device becomes securely attached to the hand held type angle grinder. Proper size bolts is provided with a holding device.

As an option, a handle can be attached and used in place of one of the bolts. This will allow a hand held type angle grinder to remain safely held and used manually as well as being supported from a tool post and used in a lathe.

A holding device also has a supporting end that is located on opposite end of a holding end. Supporting end provides a shelf area 4A for a holding device to be clamped onto by a clamping device.

Shelf area 4A extends outward, conformingly from the end and full width of main body 1A. Size of a shelf area 4A will be according to a size that fits a clamping device that its to be clamped to. As one example but not limited to, a shelf area 4A will extend outward ¾" and will be ⅝" thick, when its to be clamped by a tool post tool holder that is made for a lathe with a 10" to 15" swing.

The invention features a abrading method that, according to the invention, uses a hand held type angle grinder to abrade with while its being supported from a clamping device such as a tool post, a tool post tool holder, or a bench vise.

The invention also features a holding device. According to the invention, a holding device is used to hold a hand held type angle grinder onto a clamping device such as a tool post, a tool post tool holder, or a bench vise.

It is recognized that various alterations are possible by one of ordinary skill in the art and within the scope of the claims which follow.

What is claimed is:

1. A holding device, used for supporting a hand held type angle grinder having handle sockets, the holding device comprising:

a device which is made of a one piece construction that is equipped with two arms that reach out from each side of a main body, wherein each of said arms is equipped with a hole located at its outer end from said main body, wherein said arms extend over either side of a gear case of the hand held type angle grinder such that said holes will align with and over the grinder's side handle sockets, wherein bolts extend through said holes, and thread into said sockets, wherein the device is also equipped with a shelf area, wherein said shelf extends outward from said main body on an end opposite of said arms, wherein said shelf area can be inserted into a chamfered area of a clamping devices which fixedly secures said device thereto.

2. The holding device of claim 1, wherein said device is equipped with a shelf area, wherein said shelf extends outward from full width of supporting end of said device, wherein said shelf will be made in size according to a size of a clamping device its to be clamped by.

3. The holding device of claim 1, wherein said device will be used to support a hand held type angle grinder from a tool post, wherein said shelf area of said device will be made to fit a size of a tool post that its to be clamped by.

4. The holding device of claim 1, wherein said device will be used to support a hand held type angle grinder from a tool post tool holder, wherein said shelf area of said device will be made to fit a size of a tool post tool holder that its to be clamped by.

5. The holding device of claim 1, wherein the holding device has a means for integrally attaching the holding device to part of the gear case of the hand held angle type grinder.

* * * * *